US005927535A

United States Patent [19]

Goth

[11] Patent Number: 5,927,535

[45] Date of Patent: Jul. 27, 1999

[54] TABLET DISPENSING CLOSURE FOR CONTAINERS

[75] Inventor: Thomas P. Goth, Scottsdale, Ariz.

[73] Assignee: Top Seal Corporation, Phoenix, Ariz.

[21] Appl. No.: 09/031,331

[22] Filed: Feb. 26, 1998

[51] Int. Cl.[6] ..... B65D 51/18

[52] U.S. Cl. ..... 220/254; 220/281; 220/283; 220/833; 220/837; 220/259

[58] Field of Search ..... 220/254, 833, 220/834, 837, 281–283, 259

[56] References Cited

U.S. PATENT DOCUMENTS

| | | | |
|---|---|---|---|
| 3,837,535 | 9/1974 | Gerk . | |
| 3,845,872 | 11/1974 | Towns . | |
| 3,894,653 | 7/1975 | Ostrem . | |
| 3,929,252 | 12/1975 | La Croce . | |
| 3,957,172 | 5/1976 | Hasegawa . | |
| 3,958,718 | 5/1976 | Kowalik . | |
| 4,047,495 | 9/1977 | O'Brian | 220/281 X |
| 4,095,712 | 6/1978 | Perrella | 220/254 |
| 4,165,017 | 8/1979 | Hasegawa . | |
| 4,180,178 | 12/1979 | Turner | 220/281 |
| 4,262,802 | 4/1981 | Laauwe . | |
| 4,371,095 | 2/1983 | Montgomery et al. . | |
| 4,903,870 | 2/1990 | LaVange | 220/259 X |
| 5,007,554 | 4/1991 | Hannon . | |
| 5,082,114 | 1/1992 | Bunin | 220/283 X |
| 5,718,347 | 2/1998 | Walker et al. | 220/283 X |

FOREIGN PATENT DOCUMENTS

| | | | |
|---|---|---|---|
| 627141 | 12/1981 | Switzerland | 220/283 |

*Primary Examiner*—Allan N. Shoap
*Assistant Examiner*—Robin A Hylton
*Attorney, Agent, or Firm*—LaValle D. Ptak

[57] ABSTRACT

An improved child-resistant plastic safety closure for containers has a depending skirt on it for attaching the closure to the top of a container. The top of the closure has an opening through it, which extends over a major portion of the total area of the top. A lid with upper and lower surfaces is hinged at one edge of the opening in the top for closing the opening. Tongue-and-groove inter-engagement members between the lid member and the top, around at least part of the periphery of the opening, hold the lid closed in the opening. Diametrically-opposed, spaced-apart first and second fulcrum extensions are located on opposite sides of the opening a predetermined distance from the hinged edge of the lid member; and these fulcrum extensions are located below the lower surface of the lid member when it is closed in the opening. The fulcrum extensions protrude only a short distance into the space of the opening; and whenever a predetermined pressure is placed on the lid member in the region between the hinged edge and the first and second fulcrum extensions, the lid member flexes about a secondary hinge and raises the edge opposite the hinged edge above the top of the closure to permit that edge to be grasped and raised to pivot the lid away from the opening. This exposes the full area of the opening through the top; so that the contents of the container readily may be removed.

19 Claims, 2 Drawing Sheets

TABLET DISPENSING CLOSURE FOR CONTAINERS

BACKGROUND

Because of public concern over injuries and deaths to children caused by physically harmful materials, such as medicine, cleaning solutions and other products found in homes, the United States government has enacted regulations covering the performance criteria for safety closures for such products. These performance criteria comprise testing procedures which include attempts by representative samples of children and adults to open containers with safety closures on them within a given period of time. While it is important to reduce the percentage of children who can open such safety closures or child resistant closures, it is equally important to enable adults to be able to open the closure easily and effectively after reading accompanying instructions.

One class of products for which child resistant safety closures are required is food supplements and vitamins. While these products are not inherently harmful, overdoses of many vitamins and food supplement products can be quite harmful, particularly to children. Consequently, it is necessary, in the United States, to package many food supplement products with child resistant closures. A number of different safety closure designs have been developed, both of a snap cap and a screw cap type; but many of these closures fail to meet the stringent federal safety regulations. Such failures particularly take place when prying or biting of the cap is employed by the child or person attempting to open or remove the closure.

A closure designed to provide the desired degree of child resistant safety, which also is reclosable after opening, and which is capable of repeated opening and closing cycles, is disclosed in the patent to Towns U.S. Pat. No. 3,845,872. This patent discloses a press-down lift-up closure of the type suitable for use on vitamin containers or the like. The closure comprises a snap-fitted plug, which fits into the top of the container in such a way that there are no slots into which teeth or fingernails can extend. The top of the plug has a hollow recess formed beneath a lift tab, which is placed in the top. The lift tab is hinged at one edge and snaps into place in a groove along the other edge to hold it in place over a fulcrum extending across the closed bottom of the recess. To permit opening of the closure, the tab on the top is pressed down between the hinge and the fulcrum to pop open the opposite edge and lift it clear of the top. This opposite edge then may be grasped and used to pull the entire cap off the bottle.

The lift tab opening of the type which is disclosed in the Towns U.S. Pat. No. 3,845,872 also is used on containers for charcoal lighter and the like, where the lift tab also includes a small projection extending into and sealing a small opening in the top of a bottle when the lift tab is closed. When it is lifted out of place, the plug or projection on the underside of the lift tab is removed from the small opening in the top; so that fluid may be removed from the bottle. The opening in such a safety closure cap typically is quite small, to permit a small stream of fluid to be poured from the container closed by the cap. Closures of this type are resealable by pressing the free or unhinged edge of the lid back in place. Such closures have found widespread use.

Another tab mechanism, similar to that disclosed in the Towns U.S. Pat. No. 3,845,872, includes a base closure which is secured to the top of the container in a non-removable fashion after the container has been filled with product, such as vitamins or the like. An insert then snaps into the interior of the base closure. When the insert is snap pressed into place, it cannot easily be pried up from around the edge, since there is no lip under which a fingernail or other tool may be inserted. To permit removal of the insert, a lift tab is placed in the center of the insert. There is a hollow space provided in the insert, beneath the lift tab, and a fulcrum mechanism similar to that described above in conjunction with the Towns patent is employed. When a dot on the tab is pressed, a fulcrum causes the opposite end of the lift tab to pop upwardly. The free end then is grasped; and the entire insert is lifted out of the base closure. This exposes an opening in the container, since the insert is fully removed from the base closure. A problem which exists with an insert of this type is that it can be misplaced or lost, leaving the container open.

Another patent which is directed to a closure for a pill or vitamin container is the U.S. patent to Laauwe U.S. Pat. No. 4,262,802. This closure includes a main cap portion, which is permanently sealed to or attached to the top of the container. A "push-down, pull-up" top or cover then is placed over an opening in the main cap portion. This cover is hinged and extends across a relatively small opening in the top of the closure opposite the hinged end of the cover. Adjacent the hinged end, the top of the cover on the container includes a closed recess with a fulcrum across it; so that when the closure tab is in its closed position, it engages the fulcrum located at one edge of the recess formed in the cap. The tab is opened in a manner similar to that described above for the Towns patent; and it then can be lifted and pivoted away from the opening on the hinge to permit the contents of the container to be poured out through the opening. Because of the nature of the construction of the closure, only a limited opening in the top of the container is available. The construction of the fulcrum and the closed recessed area for applying pressure to open the tab extends over a major portion of the top of the container.

Other United States patents, such as those to Ostrem U.S. Pat. No. 3,894,653; LaCroce U.S. Pat. No. 3,929,252; Hasegawa U.S. Pat. No. 3,957,172; Kowalik et al. U.S. Pat. No. 3,958,718; Hasegawa U.S. Pat. No. 4,165,017; and Hannon U.S. Pat. No. 5,007,554 are directed to non-reclosable lift top tab mechanisms for beverage containers. While these lift top tab closures are child resistant, they are not reclosable or reusable for repeated opening and closing cycles. Consequently, the mechanisms of these patents are not appropriate for use in conjunction with pill containers or vitamin containers and the like.

It is desirable to provide a tablet dispensing closure for containers, particularly pill containers or vitamin containers, which overcomes the disadvantages of the prior art and which provides convenient dispensing of the contents of the container, without removing the closure or any part of it from the top of the container once it has been put into place.

SUMMARY OF THE INVENTION

It is an object of this invention to provide an improved dispensing closure for containers.

It is another object of this invention to provide an improved child resistant safety closure which can be opened and reclosed repeatedly.

It is a further object of this invention to provide a tablet dispensing closure for containers which may remain permanently attached to the container after opening, and which is reclosable.

It is still another object of this invention to provide an improved child resistant safety closure for a container which employs a lid attached to the closure through a living hinge, which in its closed position is secured against opening, and which is readily opened by an adult to expose substantially the entire open top of the container for access to the contents.

A preferred embodiment of the invention includes a closure which has a container top-engaging portion for sealing the top of a container. The closure itself has a top on it, with an opening through it, extending over a major portion of the area of the top of the container to provide ready access to the contents thereof. A lid is hinged at one edge of this opening for closing the opening. Inter-engagement members between the lid and the top around the periphery of the opening hold the lid closed in the opening. Spaced apart, diametrically opposed first and second fulcrum extensions are located on opposite sides of the opening a predetermined distance from the hinged edge of the lid, and are located below the lower surface of the lid when the lid is closed in the opening. Pressure on the lid in a region between the hinged edge and the first and second fulcrum extensions causes the edge of the lid opposite the hinged edge to rise above the top of the closure. This then permits the user to grasp the raised edge to pivot the lid on the hinge away from the opening. The full area of the opening then is exposed through the top of the closure.

DETAILED DESCRIPTION

Figure 1:
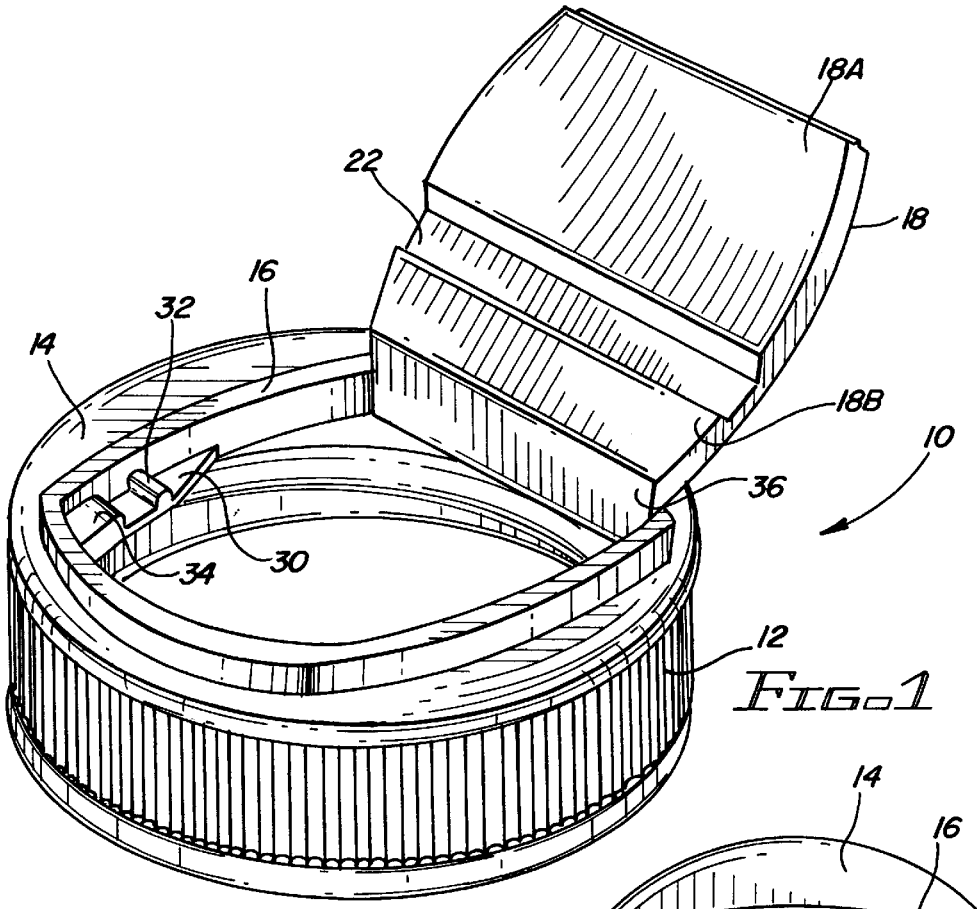
FIG. 1 is a top perspective view of a preferred embodiment of the invention.

Reference now should be made to the drawings, in which the same reference numbers are used throughout the different figures to designate the same components. FIG. 1 is a top perspective view of a preferred embodiment of the invention. A tablet dispensing closure which also may be a child resistant safety closure 10 includes a depending cylindrical skirt 12, which is internally threaded to fit over the top of a container, such as a vitamin container or the like. The closure typically is placed over the top of a container (not shown) after the container has been filled. This placement is in a conventional manner. Once the closure 10 is in place, it also may be sealed to the container top by using double-sided inductive foil; so that the cap 10 cannot thereafter be screwed off the top of the container. If this is done, the result is a child resistant safety closure. To permit access to the contents of the container once the closure 10 has been placed on the top of the container, a reclosable lid 18 is placed in the top 14 of the closure. The lid 18 is placed inside a raised lip 16; so that when it is closed, the upper surface or top of the lid 18 is flush with the upper edge of the raised lip 16.

The lid 18 comprises two primary sections 18A and 18B, which are separated by a secondary hinge or thinner area 22, as shown most clearly in FIGS. 1 and 6 through 8. A primary living hinge 36 attaches one edge of the lid 18 (the right-hand edge in all of the figures) to the edge of the raised portion or lip 16, as shown most clearly in FIGS. 1 and 6 through 8. It should be noted that the closure 10, including all of its various parts, is molded as a unitary plastic part, in a single piece. When the lid 18 is in the closed position shown in FIGS. 2 and 4, all of the edges of the lid 18 are in close fitting abutment to the edges of the lip 16; and the upper surface of the lid 18 is flush with the upper surface of the lip 16; so that the lid cannot be pried open.

Figure 3:
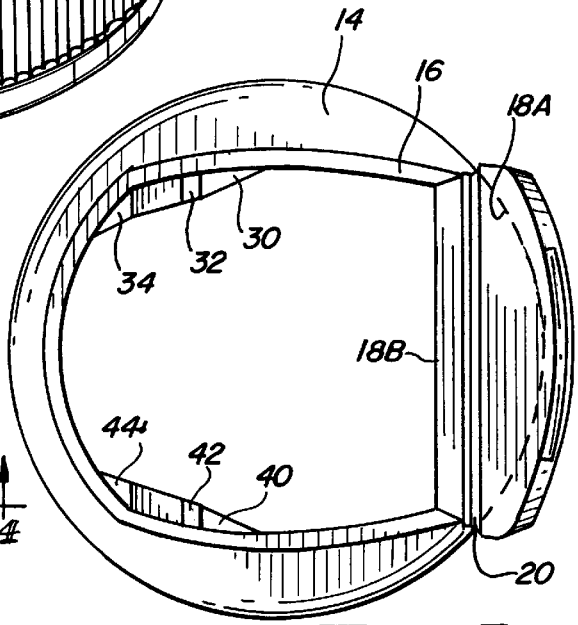
FIG. 3 is a top view of the embodiment of FIG. 1 in the open position of operation.

Tongue-and-groove inter-engagement members 38 and 39 on the left-hand edge of the lip 16 and the left-hand edge (as viewed in all of the figures) of the lid 18 are provided to positively lock the lid 18 in place when it is pressed down firmly against a pair of spaced support shoulders 34 and 44, which are located on a pair of shelves 30 and 40 on opposite sides of the opening, as shown most clearly in FIG. 3.

The shoulders 30 and 40 also support a pair of short fulcrum extensions 32 and 42, which are located on opposite sides of the opening in the top of the cap within the area defined by the lip 16. These fulcrum extensions 32 and 42 are parallel to the primary living hinge 36, which attaches the lid 18 to the lip 16; and they are located intermediate the distance between the living hinge 36 and the front or forward edge of the lid 18 which has the tongue 39 on it.

Figure 2:
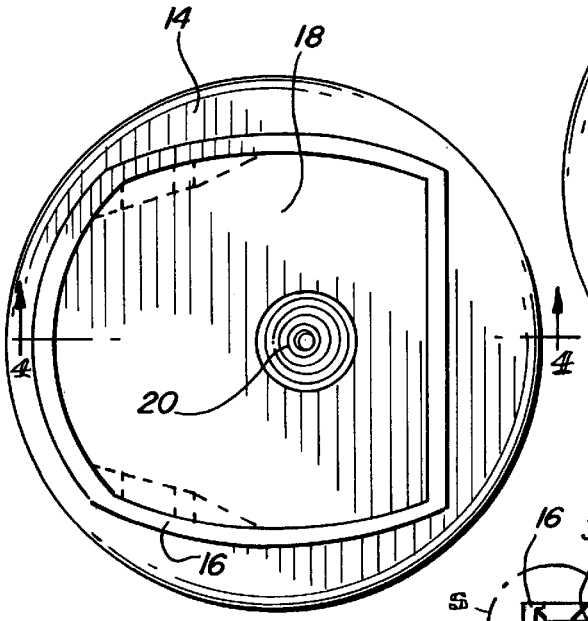
FIG. 2 is a top view of the embodiment of FIG. 1 in the closed position of operation.
Figure 4:
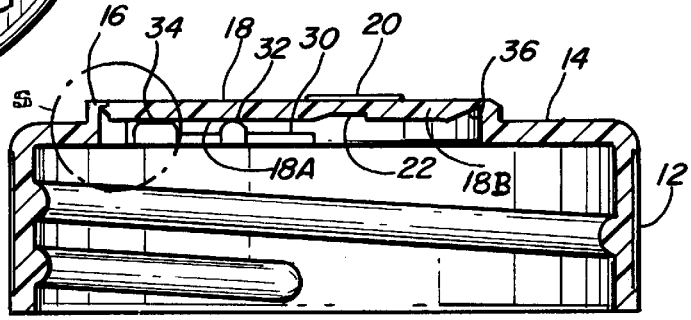
FIG. 4 is a cross-sectional view taken along the line 4—4 of FIG. 2.
Figure 5:
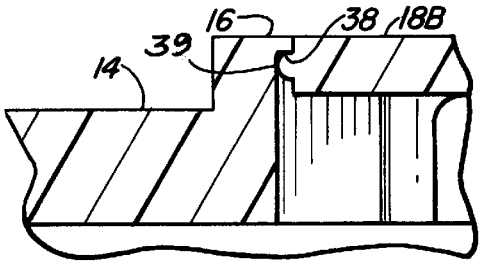
FIG. 5 is an enlarged detail of the portion circled as 5 in FIG. 4.
Figure 6:
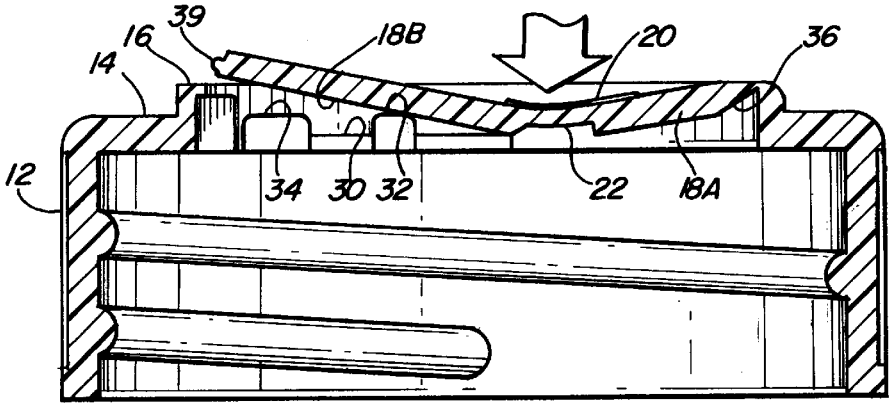
FIG. 6 illustrates a step in the operation of the opening of the closure.

To lift the free end of the lid 18 out of the engaged position shown in FIGS. 2, 4 and 5, a circular depression area 20 is provided for engagement by the force of a finger or other suitable means in the direction of the arrow shown in FIG. 6. This downward force is applied to the upper surface of the lid 18. As shown in FIG. 6, this causes the lid 18 to flex between the living hinge 36 and the fulcrum extensions 30 and 42 about the secondary hinge 22 formed on the underside or lower surface of the lid 18. Thus, the sections 18A and 18B of the lid bend in the manner shown in FIG. 6 to raise the tongue 39 out of engagement with the groove 38 in the lip 16 to the position shown in FIG. 6. The strength of all of the different portions of the closure and the lid described thusfar are selected to require a force of approximately four pounds, and preferably between four pounds and twelve pounds, applied in the direction of the arrow shown in FIG. 6 to cause the opening of the lid in the manner shown in FIG. 6. Once the left-hand edge or the free edge containing the tongue 39 is raised to the position shown in FIG. 6, pressure on the region 20 may be released. The end of the lid 18, which now extends above the top periphery of the lip 16, may be grasped and pivoted about the living hinge 36 to the position shown in FIG. 8.

Figure 8:
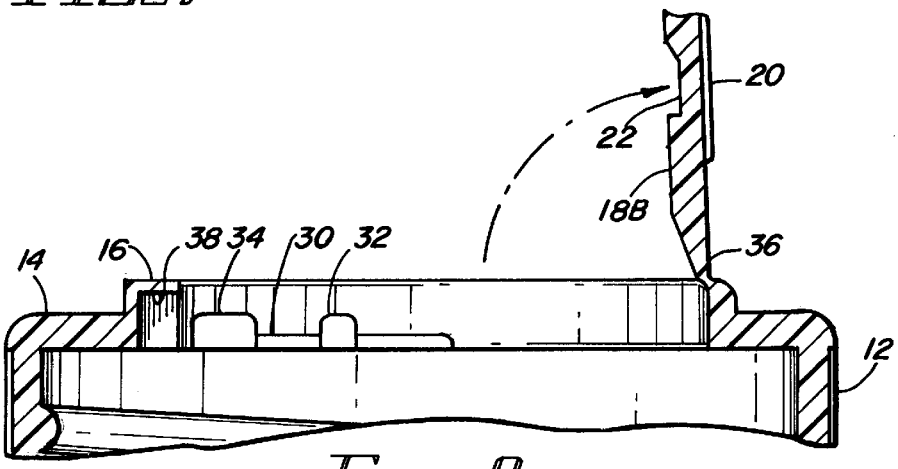
FIG. 8 illustrates a final step in the operation of the opening of the closure.

When the container on which the closure 10 is located has been opened to the position shown in FIG. 8, the contents of the container are fully exposed through the opening, as shown in FIG. 3. The upper edge of the top of a container (not shown) when the closure 10 is screwed down onto the container, typically extends to a position which is close to the curved periphery of the lip 16, as shown in the top views in both FIGS. 2 and 3. Consequently, it is apparent that substantially the entire top of the container is open when the lid 18 is placed in the position shown in FIGS. 3 and 8; so that easy access to the contents of the container on which the closure 10 is used is obtained.

The shoulders 30 and 40 extend only a short distance into the opening area, as is apparent from an examination of FIGS. 1 and 3. The fulcrum extensions 32 and 42 act only on the outer or peripheral edges of the portion 18A of the lid; but pressure in this region is sufficient to provide the operation shown in FIGS. 6 and 7 to permit opening of the lid 18. Consequently, a fulcrum extending all the way across the opening or all the way across the lower surface of the section 18A of the lid 18 is not required for effectively utilizing this reclosable safety closure.

Figure 7:
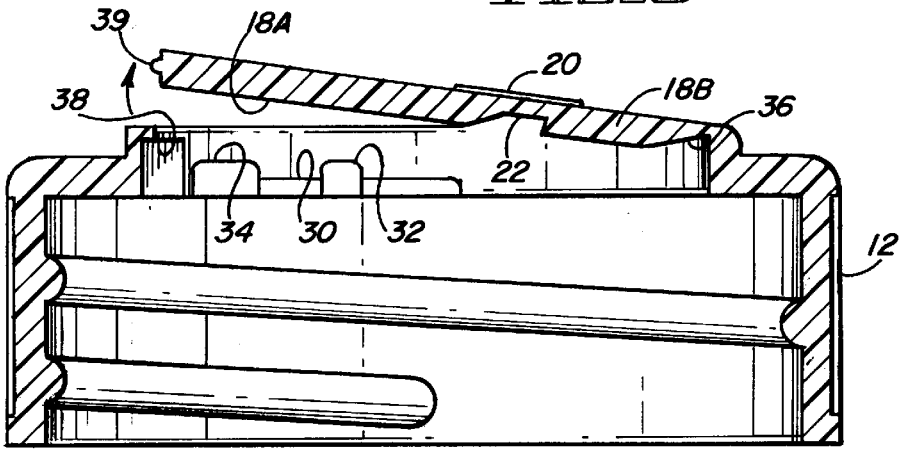
FIG. 7 illustrates a further step in the operation of the opening of the closure.

When the closure is to be reclosed, the lid 18 is pivoted in the opposite direction of the arrows shown in FIGS. 7 and 8 to the position shown in FIG. 4. Pressure on the upper surface of the lid 18, along the edge of the lid opposite the living hinge 36, forces the tongue 39 beneath the groove 38 and firmly closes the lid. The support ledges 34 and 44 prevent the portion 18A of the lid 18 from being pressed beyond the position needed to inter-engage the tongue and groove parts 38 and 39; so that the lid may be firmly and reliably closed by a firm pressure pressing the lower surface of the portion 18A down onto the support ledges 34 and 44.

The child resistant closure which has been described is capable of repeated opening and closing; so that product located within the container with which the closure is used may be removed in any desired amount. Reclosure of the lid 18 seals the product in the package and prevents access by children, who typically are incapable of providing the four pound to twelve pound force required to pop open the tongue-and-groove inter-engagement members 38 and 39. The tongue-and-groove inter-engagement members 38 and 39 function to cause the lid to close with a snap action and to release, with the force described above, with a corresponding type of action.

The plastic out of which the closure 10 is made may be any suitable currently available plastic capable of providing the desired rigidity, with sufficient resiliency in the primary living hinge and the secondary hinge 22 to perform the functions described. Suitable plastics require sufficient elasticity to permanently lock closed the lid after closing in the manner described above, and also permit inherent elasticity to allow the functions of the living hinge 36 and the weakened area 22 in the manner described above.

The foregoing description of the preferred embodiment of the invention is to be considered as illustrative and not as limiting. Various changes will occur to those skilled in the art for performing substantially the same function, in substantially the same way, to achieve substantially the same result without departing from the true scope of the invention as defined in the appended claims.

What is claimed is:

1. A tablet dispensing closure for a container top including in combination:

a container top-engaging portion on said dispensing closure for closing a container;

a top on said dispensing closure having an opening with a periphery therethrough covering a major portion of the area of said dispensing closure top;

a lid member having upper and lower surfaces and hinged at one edge of said opening for closing said opening;

inter-engagement members between said lid member and at least a portion of said dispensing closure top around the periphery of said opening to hold said lid member closed in said opening; and spaced-apart, diametrically-opposed, first and second fulcrum extensions located on opposite sides of said opening a predetermined distance from said hinged edge of said lid member and below said lower surface of said lid member when said lid member is closed in said opening, wherein predetermined pressure on said lid member in a region between said hinged edge and said first and second spaced apart fulcrum extensions causes the edge of said lid member opposite said hinged edge to raise above the top of said dispensing closure to permit grasping of said lid member to pivot said lid member about said hinged edge thereof away from said opening, exposing the full area of said opening through said dispensing closure top.

2. The combination according to claim 1 wherein said lid member has a secondary hinge extending thereacross parallel to said hinged edge on the lower surface thereof between said hinged edge and said spaced-apart fulcrum extensions.

3. The combination according to claim 2 wherein said predetermined pressure is in the range from about four pounds to twelve pounds.

4. The combination according to claim 3 wherein said first and second fulcrum extensions extend into said opening less than ten percent of the width of said opening on a line passing between said first and second fulcrum extensions.

5. The combination according to claim 4 wherein said inter-engagement members comprise tongue-and-groove members on said lid member and said dispensing closure top around at least a portion of the periphery of said opening.

6. The combination according to claim 5 further including a support member located on said closure and extending into said opening adjacent the edge of said lid member opposite said hinged edge to permit engagement of said inter-engagement members when said lid member is firmly pressed down against said support member.

7. The combination according to claim 6 wherein said dispensing closure is made of plastic material.

8. The combination according to claim 7 wherein said dispensing closure is made of molded plastic material.

9. The combination according to claim 8 further including a depending skirt on said safety closure for engagement with a top of a container.

10. The combination according to claim 1 wherein said inter-engagement members comprise tongue-and-groove members on said lid member and said dispensing closure top around at least a portion of the periphery of said opening.

11. The combination according to claim 10 wherein said first and second fulcrum extensions extend into said opening less than ten percent of the width of said opening on a line passing between said first and second fulcrum extensions.

12. The combination according to claim 11 further including a support member located on said dispensing closure and extending into said opening adjacent the edge of said lid member opposite said hinged edge to permit engagement of said inter-engagement members when said lid member is firmly pressed down against said support member.

13. The combination according to claim 1 further including a depending skirt on said dispensing closure for engagement with the top of a container.

14. The combination according to claim 1 wherein said dispensing closure is made of plastic material.

15. The combination according to claim 14 wherein said dispensing closure is made of molded plastic material.

16. The combination according to claim 1 wherein said predetermined pressure is in the range from about four pounds to twelve pounds.

17. The combination according to claim 1 wherein said first and second fulcrum extensions extend into said opening less than ten percent of the width of said opening on a line passing between said first and second fulcrum extensions.

18. The combination according to claim 17 further including a support member located on said dispensing closure and extending into said opening adjacent the edge of said lid member opposite said hinged edge to permit engagement of said inter-engagement members when said lid member is firmly pressed down against said support member.

19. The combination according to claim 1 further including a support member located on said dispensing closure and extending into said opening adjacent the edge of said lid member opposite said hinged edge to permit engagement of said inter-engagement members when said lid member is firmly pressed down against said support member.

* * * * *